US008281499B2

(12) United States Patent
Friesen et al.

(10) Patent No.: US 8,281,499 B2
(45) Date of Patent: Oct. 9, 2012

(54) MOBILE SURFACE DRYING APPARATUS

(76) Inventors: John Friesen, Leamington (CA); Jacob Friesen, Leamington (CA); Rob Brush, Kingsville (CA)

( * ) Notice: Subject to any disclaimer, the term of this patent is extended or adjusted under 35 U.S.C. 154(b) by 441 days.

(21) Appl. No.: 12/512,270

(22) Filed: Jul. 30, 2009

(65) Prior Publication Data

US 2010/0024242 A1 Feb. 4, 2010

Related U.S. Application Data

(60) Provisional application No. 61/085,122, filed on Jul. 31, 2008.

(51) Int. Cl.
*F26B 5/12* (2006.01)

(52) U.S. Cl. ..... 34/92; 34/69

(58) Field of Classification Search ..... 34/423, 34/426, 92, 406, 418, 69; 126/271.1
See application file for complete search history.

(56) References Cited

U.S. PATENT DOCUMENTS

| | | | | |
|---|---|---|---|---|
| 3,902,219 | A * | 9/1975 | Jones | 15/314 |
| 4,571,849 | A * | 2/1986 | Gardner et al. | 34/79 |
| 4,730,692 | A * | 3/1988 | Fair et al. | 181/114 |
| 4,781,933 | A * | 11/1988 | Fraioli | 34/266 |
| 5,020,237 | A * | 6/1991 | Gross et al. | 34/265 |
| 5,189,832 | A * | 3/1993 | Hoek et al. | 126/271.1 |
| 5,533,577 | A * | 7/1996 | Jucker | 172/21 |
| 6,049,943 | A * | 4/2000 | Carter | 15/340.3 |
| 6,189,179 | B1 * | 2/2001 | Baird | 15/364 |
| 6,298,578 | B1 * | 10/2001 | Frampton | 34/465 |

FOREIGN PATENT DOCUMENTS

SU 713131 B * 12/1980

* cited by examiner

*Primary Examiner* — Jiping Lu
(74) *Attorney, Agent, or Firm* — Carlson, Gaskey & Olds PC

(57) ABSTRACT

A mobile surface drying apparatus includes a vacuum and blower assembly. The vacuum and blower assembly includes a vacuum head and a blower head. The vacuum head suctions moisture through an inlet of the vacuum and blower assembly, and the blower head communicates airflow through an outlet of the vacuum and blower assembly.

13 Claims, 5 Drawing Sheets

MOBILE SURFACE DRYING APPARATUS

CROSS-REFERENCE TO RELATED APPLICATIONS

This application claims priority to U.S. Provisional Application No. 61/085,122, filed Jul. 31, 2008.

BACKGROUND OF THE DISCLOSURE

This disclosure relates generally to a mobile surface drying apparatus, and more particularly to an apparatus that extracts moisture that accumulates on a surface after a moisture generating event.

Many spectators at sporting events suffer through numerous race delays. For example, at a race car event, moisture may accumulate on the racetrack after a moisture generating event, such as a rainfall, has ceased. A relatively significant amount of time, expense and effort must be exhausted to remove the moisture from the racetrack prior to resuming the sporting event.

SUMMARY OF THE DISCLOSURE

A mobile surface drying apparatus includes a vacuum and blower assembly. The vacuum blower assembly includes a vacuum head and a blower head. The vacuum head suctions moisture through an inlet, and the blower head communicates airflow through an outlet.

A mobile surface drying apparatus includes a vehicle structure, a carriage, and a first vacuum and blower assembly. The vehicle structure is positioned to traverse along a surface. The carriage is integrated with the vehicle structure. The first vacuum and blower assembly is mounted to one of the vehicle structure and the carriage. The first vacuum and blower assembly simultaneously communicates airflow through each of an inlet and an outlet to extract moisture from the surface.

A method for removing moisture from a surface with a mobile surface drying apparatus having a vacuum and blower assembly includes suctioning the moisture from the surface with the vacuum and blower assembly, and communicating an airflow onto the surface with the vacuum and blower assembly.

The various features and advantages of this disclosure will become apparent to those skilled in the art from the following detailed description. The drawings that accompany the detailed description can be briefly described as follows.

DETAILED DESCRIPTION OF THE DISCLOSED EMBODIMENTS

Figure 1:
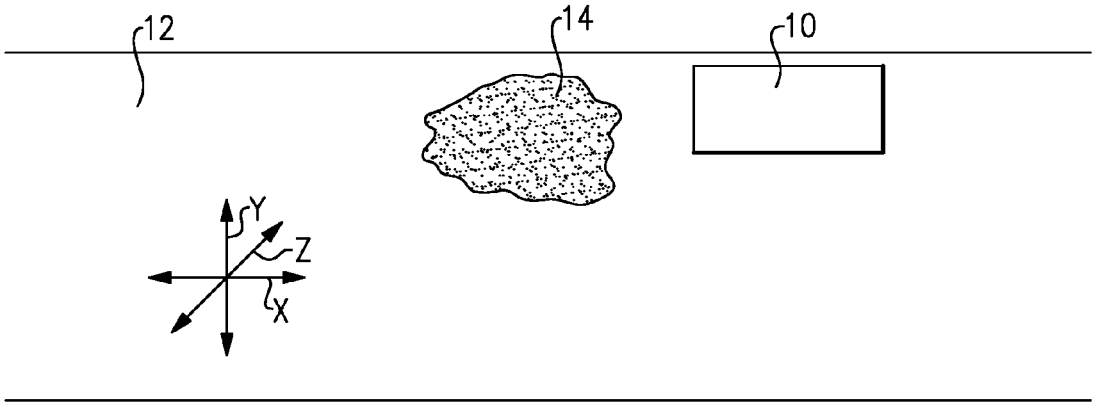
FIG. 1 schematically illustrates an example mobile surface drying apparatus for removing and/or drying a moisture burdened surface.

FIG. 1 schematically illustrates a mobile surface drying apparatus 10 positioned to traverse along a surface 12. The surface 12 includes moisture 14 which has accumulated thereon following a moisture producing event, such as a rainfall, for example. The surface 12 may include a paved roadway, such as an asphalt, concrete, compacted gravel, dirt or other similar roadway. In one example, the surface 12 is a race track. A person of ordinary skill in the art would understand that the various features and advantages of this disclosure are applicable to any surface 12 that is susceptible to accumulating moisture.

The mobile surface drying apparatus 10 is traversable along the surface 12 in any direction, including an east/west path X, a north/south path Y and a transverse path Z. The mobile surface drying apparatus 10 extracts, dissipates, retains in a holding tank, and/or evaporates the moisture 14 that accumulates on the surface 12. In this disclosure, the moisture 14 that is extracted by the mobile surface drying apparatus 10 may include water, oil or any other liquid based substance that may accumulate on the surface 12. The mobile surface drying apparatus 10 is also capable of cleaning the surface 12, including removing debris, as is further discussed below.

Figure 2:
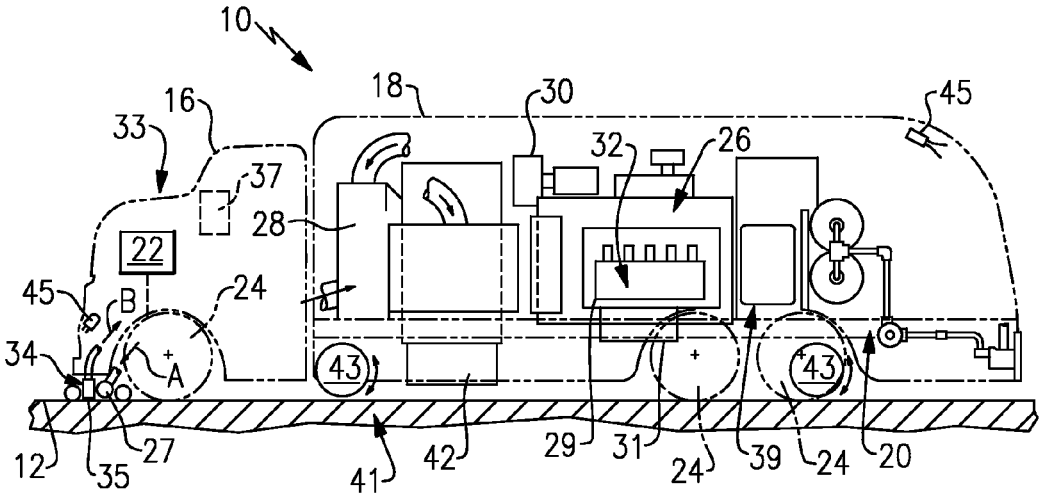
FIG. 2 illustrates an example mobile surface drying apparatus including a vacuum and blower assembly.

FIG. 2 illustrates an example mobile surface drying apparatus 10 for extracting the moisture 14 from the surface 12. In this example, the mobile surface drying apparatus 10 is a self-propelled vehicle that includes an operator cab 16 and a shell 18 connected aft of the operator cab 16. The shell 18 and operator cab 16 encompasses the numerous components of the mobile surface drying apparatus 10 that are supported by a carriage 20. In one example, the carriage 20 is a fabricated frame that provides the foundation for the numerous mounted units of the mobile surface drying apparatus 10. A person of ordinary skill in the art having the benefit of this disclosure would be able to select an appropriate material to construct the carriage 20. Although shown incorporated with a self-propelled vehicle, the carriage 20 may also be integrated within a tow trailer, a truck mount or any other vehicle structure that is capable of supporting the mobile surface drying apparatus 10.

In the illustrated example, the mobile surface drying apparatus 10 is a self-propelled vehicle. The operator cab 16 houses a hydrostatic drive 22 that powers the wheels 24 of the mobile surface drying apparatus 10 for traversing the mobile surface drying apparatus 10 at an operational speed along a desired path of the surface 12. In one example, the operational speed of the mobile surface drying apparatus 10 is approximately one mile per hour to approximately ten miles per hour. A person of ordinary skill in the art having the benefit of this disclosure would be able to design a self-propelled mobile surface drying apparatus that is capable of traversing along the surface 12 at a desired speed.

An internal combustion engine 26 powers the numerous components of the mobile surface drying apparatus 10. In this example, the internal combustion engine 26 drives a vacuum fan 28 and a blower fan 30 via a direct drive connection, such as a belt connection, for example. In another example, the blower fan 30 is driven by a separate electric motor. The internal combustion 26 also powers a hydraulic system 32 that powers the numerous onboard hydraulic mechanisms of the mobile surface drying apparatus 10. The hydraulic system 32 includes a hydraulic manifold 29 and a hydraulic reservoir 31.

The example mobile surface drying apparatus 10 includes a vacuum and blower assembly 34 that is powered by the vacuum fan 28 and the blower fan 30. In this example, the vacuum and blower assembly 34 is positioned near a front portion 33 of the operator cab 16. The vacuum and blower assembly 34 is selectively actuable to engage the surface 12 to extract, dissipate and/or evaporate the moisture 14 on the surface 12. The example vacuum and blower assembly 34 simultaneously communicates an airflow A onto the surface 12 and suctions the moisture 14 in a direction B opposite from the airflow A. That is, the example vacuum and blower assembly 34 includes an inlet 35 that generates a suction force and an outlet 27 that communicates an airflow onto the surface 12.

The mobile surface drying apparatus 10 further includes an operator communication interface 37 housed within the operator cab 16. The operator communication interface 37 is in electrical communication with an electric panel 39, which interconnects the wiring from the various components of the mobile surface drying apparatus 10. The operator communication interface 37, the electric panel 39 and the hydraulic system 32 cooperate to control the functioning of the numerous components of the mobile surface drying apparatus 10. A person of ordinary skill in the art having the benefit of this disclosure would understand how to design these components to control the functionality of the mobile surface drying apparatus 10.

The operator communication interface 37 acts as the command center for the mobile surface drying apparatus 10. For example, each system and associated component (i.e., the vacuum and blower assembly 34, etc.) of the mobile surface drying apparatus 10 is independently activated/deactivated by the operator via the operator communication interface 37. The operator communication interface also provides diagnostic information to the operator, including displaying component performance and warning aids to the operator.

In one example, the vacuum and blower assembly 34 is engaged relative to the surface 12 at the command of the operator via the operator communication interface 37. The vacuum and blower assembly 34 will not function to extract moisture from the surface 12 absent a command from the operator communication interface 37. In one example, the operator communication interface 37 selectively commands the hydraulic system 32 to lift, lower, extend, and/or retract the components of the mobile surface drying apparatus 10 to enable the extraction of moisture 14 from the surface. The carriage 20 may be hydraulically controlled by the hydraulic system 32 at the command of the operator communication interface 37 to position the carriage 20 at a desired spacing relative to the surface 12. In one example, the hydraulic system 32 includes pneumatic cylinders (not shown) for positioning the carriage 20.

A traction control system 41 is also selectively actuable by the operator via command from the operator communication interface 37. The traction control system 41 includes a plurality of dual contact wheels 43 that are lowered and raised to selectively engage/disengage the surface 12. The dual contact wheels 43 are raised and lowered via the hydraulic system 32. The traction control system 41 permits the mobile surface drying apparatus 10 to remain square to the surface 12 during areas of steep embankments, such as 30°-40° banked roadways encountered on race tracks, and reduces the tendency of the mobile surface drying apparatus 10 to slide down the embankments. The traction control system 41 may also include additional outrigger dropdown support wheels and counterweights that provide additional stability to the mobile surface drying apparatus 10.

A plurality of video cameras 45 are strategically located about the mobile surface drying apparatus 10 to provide the operator with visual confirmation of the positioning of the mobile surface drying apparatus 10 and the effectiveness of the moisture extraction. In one example, the operator communication interface 37 includes a video monitor that provides the operator with a live feed of the video recorded by the video cameras 45.

Figure 3:
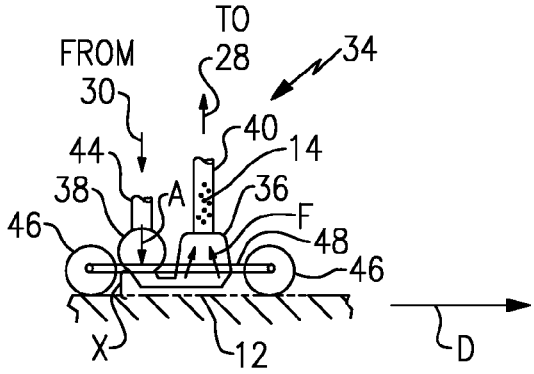
FIG. 3 illustrates an example vacuum and blower assembly for the mobile surface drying apparatus illustrated in FIG. 2.
Figure 5:
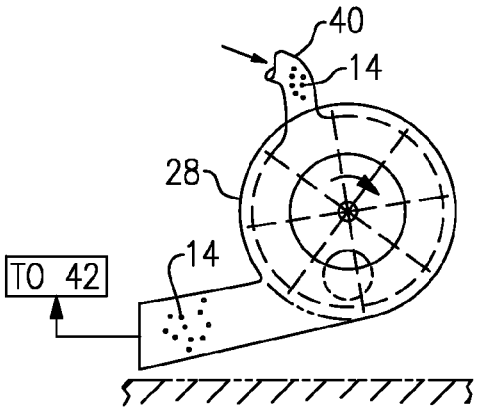
FIG. 5 illustrates a blower fan of the example mobile surface drying apparatus of FIG. 2.

FIG. 3 illustrates an example vacuum and blower assembly 34 for use within the mobile surface drying apparatus 10 of FIG. 2. The vacuum and blower assembly 34 includes a vacuum head 36 and a blower head 38. The vacuum head 36 is powered by the vacuum fan 28. Tubing 40 connects the vacuum head 36 with the vacuum fan 28. The tubing 40 could include flexible tubing, rigid tubing, or a combination of flexible and rigid tubing. The vacuum head 36 suctions moisture away from the surface 12 and into the tubing 40 via a suction force F. The moisture 14 is communicated through the tubing 40, is passed through the vacuum fan 28, and is expelled at high velocity through an exhaust chute 42 (See FIG. 5).

The blower head 38 is powered by the blower fan 30, and is operable to communicate an airflow A from the vacuum and blower assembly 34 onto the surface 12 to dry the surface 12. The blower head 38 also effectively directs the moisture 14 toward the vacuum head 36 to enable to vacuum head 36 to extract the moisture 14 from the surface 12. The blower head 38 is connected to the blower fan 30 via flexible tubing 44. The vacuum head 36 and the blower head 38 are mounted between rollers 46 on a support bracket 48. In this example, the vacuum head 36 is positioned fore the blower head 38 as the vacuum and blower assembly 34 traverses in a direction D along the surface 12.

The vacuum and blower assembly 34 is positionable at a distance X relative to the surface 12. The actual value of the distance X is not critical; however, a person of ordinary skill in the art having benefit of this disclosure would understand that it is desirable to position the vacuum and blower assembly 34 in close proximity to the surface 12, and would be able to position the vacuum and blower assembly 34 at any desired distance relative to the surface 12.

Figure 4A:
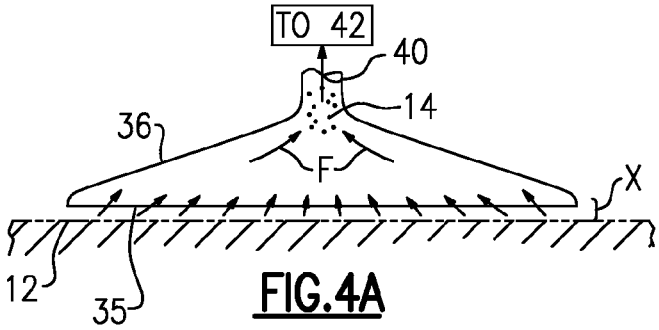
FIGS. 4A and 4B illustrate an example vacuum head and an example blower head of the vacuum and blower assembly of FIG. 3.
Figure 4B:
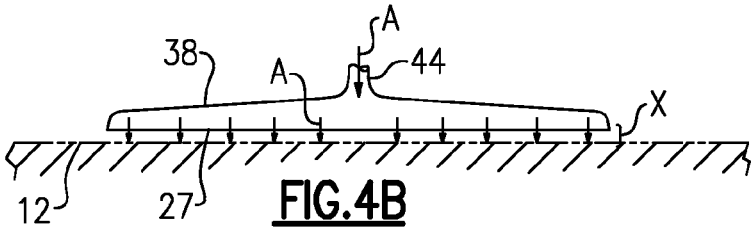

FIGS. 4A and 4B illustrate the vacuum head 36 and the blower head 38, respectively. The vacuum head 36 includes a long, narrow inlet 35 that captures the moisture 14 and surface particulate via suction and passes it through the flexible tubing 40 to the exhaust chute 42. In this example, the moisture 14 and particulate suctioned from the surface 12 is expelled at high velocity through the exhaust chute 42 on the left hand side of the mobile surface drying apparatus 10. The remaining moisture 14 will be collected by the mobile surface drying apparatus 10 on its next pass across the surface 12. That is, the mobile surface drying apparatus 10 works from the top of the surface 12 down to extract the moisture. The actual dimensions of the vacuum head 36 will vary depending upon design specific parameters, including the size of the mobile surface drying apparatus 10 and the size of the surface 12 being dried.

As depicted in FIG. 4B, the blower head 38 includes a long, narrow outlet 27 for communicating the airflow A from the blower fan 30 through the flexible tubing 44 and onto the surface 12. The airflow A communicated onto the surface 12 facilitates drying of the surface 12. The actual dimensions of the blower head 38 will vary depending upon design specific parameters, including the size of the mobile surface drying apparatus 10 and the size of the surface 12 being dried.

Figure 6A:
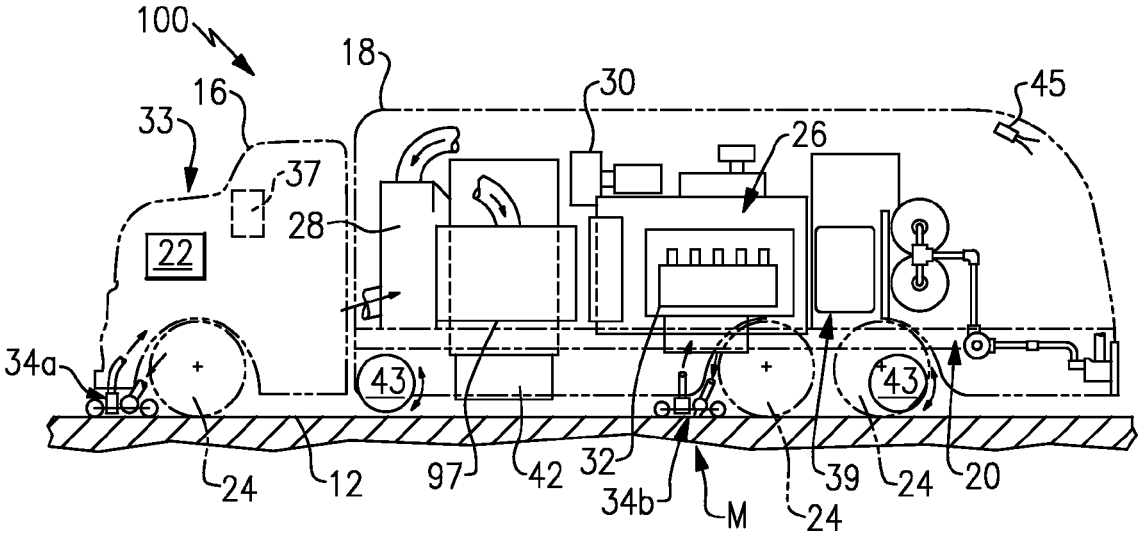
FIGS. 6A and 6B illustrate additional examples of mobile surface drying apparatuses.
Figure 6B:
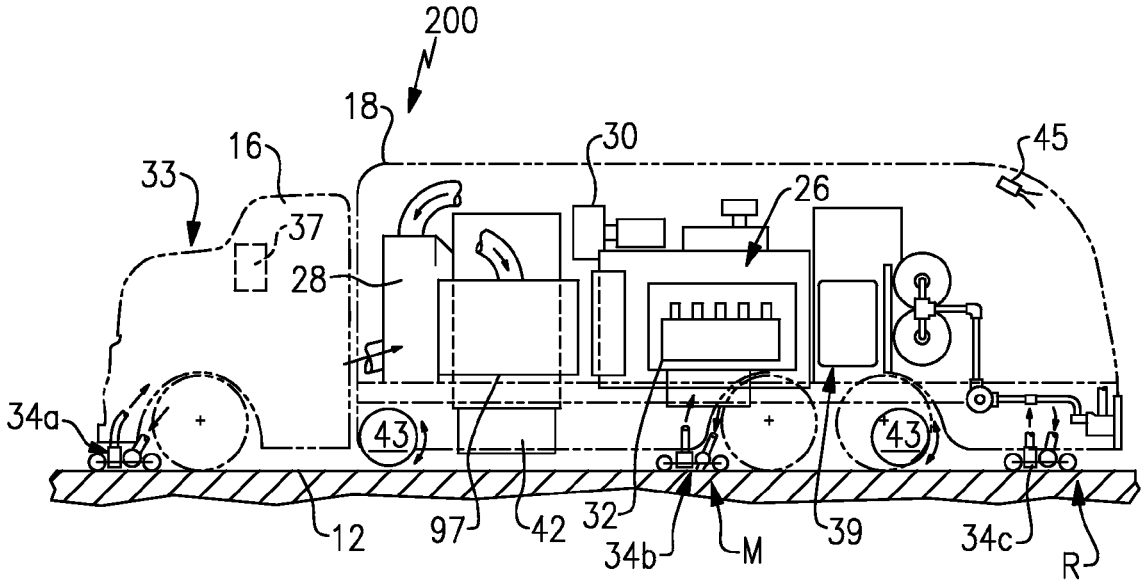

FIGS. 6A and 6B illustrate additional example mobile surface drying apparatuses 100, 200. In this disclosure, like reference numerals designate like elements where appropriate, and reference numerals with the addition of 100 or multiples thereof designate modified elements. It is to be understood that the modified elements incorporate the same features and benefits of the corresponding original elements, except where stated otherwise. The example mobile surface drying apparatus 100 includes a first vacuum and blower assembly 34A and a second vacuum and blower assembly 34B positioned aft from the first vacuum and blower assembly 34A. In this example, the first vacuum and blower assembly 34A is mounted near a front portion 33 of the operator cab 16 and the second vacuum and blower assembly 34B is mounted to the carriage 20 at approximately the midpoint M of the shell 18. In one example, the second vacuum and blower assembly 34B is mounted between the wheels 24 of the mobile surface drying apparatus 100. It should be understood that the vacuum and blower assemblies 34A, 34B may be mounted at any location along the length of the mobile surface drying apparatus 100.

FIG. 6B illustrates another example mobile surface drying apparatus 200. In this example, the mobile surface drying apparatus 200 includes a first vacuum and blower assembly 34A, a second vacuum and blower assembly 34B and a third vacuum and blower assembly 34C. The first vacuum and blower assembly 34A is positioned near a front portion 33 of the mobile surface drying apparatus 200, the second vacuum and blower assembly 34B is positioned near a middle portion M of the mobile surface drying apparatus 200, and the third vacuum and blower assembly 34C is positioned near a rear most portion R of the mobile surface drying apparatus 200. The depicted positioning of the vacuum and blower assemblies 34A, 34B and 34C is included for illustration only, and a person of ordinary skill in the art having the art having the benefit of this disclosure would be able to select an appropriate mounting location for each vacuum and blower assembly 34 desired. In addition, although the figures depict mobile surface drying apparatuses having between one vacuum and blower assembly and three vacuum and blower assemblies, it should be understood that any number of vacuum and blower assemblies 34 may be utilized to extract, dissipate and/or evaporate moisture from a surface 12.

Figure 7A:
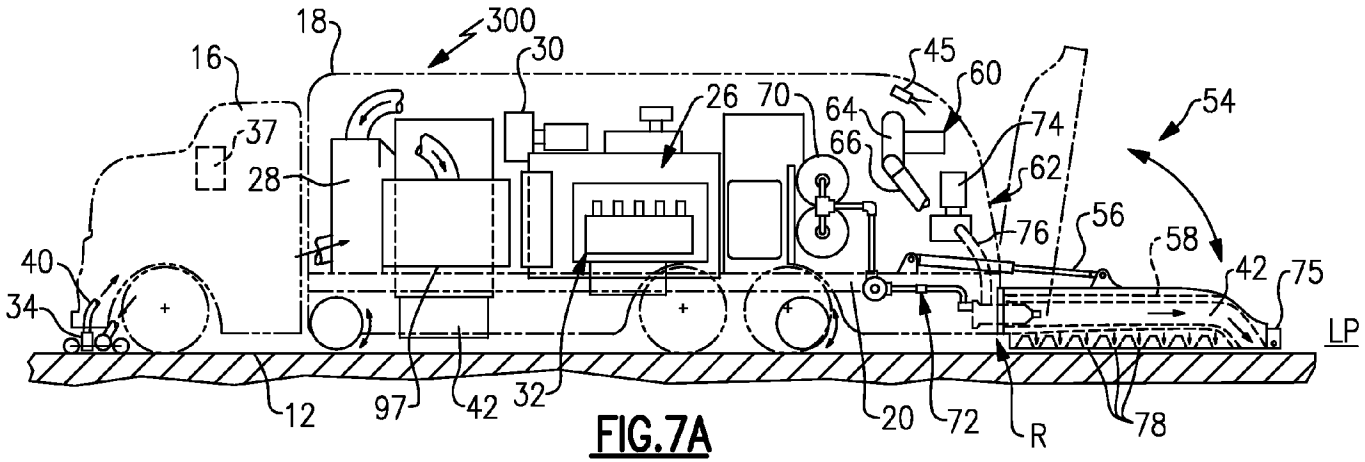
FIG. 7A illustrates another example mobile surface drying apparatus.

FIG. 7A illustrates yet another example mobile surface drying apparatus 300. The example mobile surface drying apparatus 300 includes a vacuum and blower assembly 34 and a dryer assembly 54. Although only one vacuum and blower assembly 34 is depicted, additional vacuum and blower assemblies 34 may be utilized to improve the extraction of moisture from the surface 12.

The dryer assembly 54 communicates hot air onto the surface 12 for facilitating the removal of the moisture 14 from the surface 12. The example dryer assembly 54 includes a forced air platform 58, an airflow system 60 and a jet burner system 62. The airflow system 60 includes a plurality of high flow air blowers 64 each having their own ducting 66 that communicate airflow to the forced air platform 58.

Figure 7B:
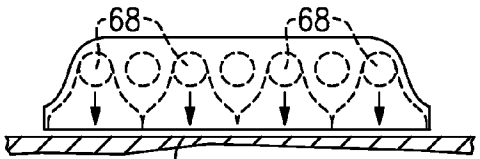
FIG. 7B illustrates a jet burner system of the dryer assembly of the mobile surface drying apparatus of FIG. 7.

The jet burner system 62 of the dryer assembly 54 includes a plurality of jet burners 68 (See FIG. 7B) that are fired by a propane tank 70 and a fuel delivery system 72. Each jet burner 68 includes a blower component 74 that feeds the fresh air required for combustion at high velocity through a burner ducting 76. The high velocity fresh air from the blower component 74 heats the pressurized air from the airflow system 60 within the forced air platform 58, and the airflow is then forced through a multitude of vent slots 78 of the forced air platform 58 to dry the surface 12. In one example, the hot air is exhausted at a minimum of 550° F. and 1000-1500 CFM per vent slot 78. A heat sensor 75 mounted to the force air platform 58 monitors the temperature of the surface 12 maintain safe heating conditions.

The forced air platform 58 is mounted to the carriage 20 adjacent an rear most portion R of the mobile surface drying apparatus 300. In one example, the forced air platform 58 is mounted to the carriage 20 via a hydraulic cylinder 56. However, other mounting configurations are contemplated as within the scope of this disclosure. In one example, the forced air platform 58 is only operable when engaged in a lowered position LP relative to the surface 12.

Figure 8:
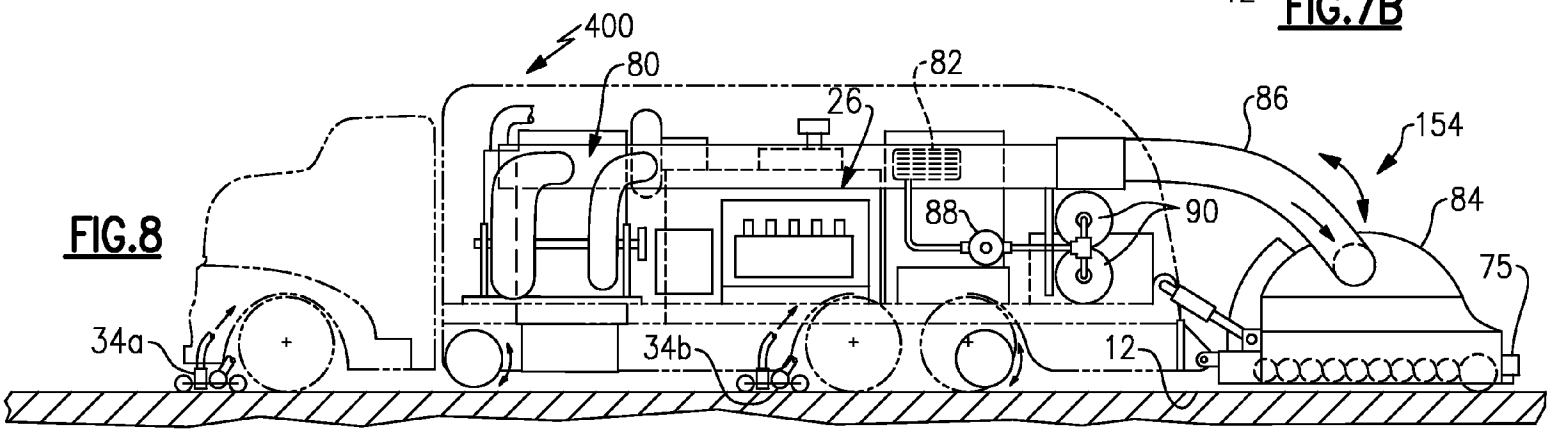
FIG. 8 illustrates yet another example mobile surface drying apparatus.

FIG. 8 illustrates yet another example mobile surface drying apparatus 400. The example mobile surface drying apparatus 400 includes a first vacuum and blower assembly 34A, a second vacuum and blower assembly 34B and an example dryer assembly 154. The vacuum and blower assemblies 34A, 34B function as describe above. In this example, the dryer assembly 154 includes a blower assembly 80, a burner 82 and a hot air platform 84.

The internal combustion engine 26 powers the blower assembly 80, which directs heated air through the ducting 86 to the hot air platform 84 to facilitate a final stage of drying of the surface 12. The burner 82 heats the air communicated from the blower assembly 80 prior to communicating the air to the hot air platform 84. In one example, the burner 82 heats the air to approximately 800° F. and 12,000 CFM. A fuel delivery system 88 having fuel tanks 90 fires the burner 82. In one example, the blower assembly 80 includes two centrifuge blowers that are belt driven by the internal combustion engine 26.

Figure 9:
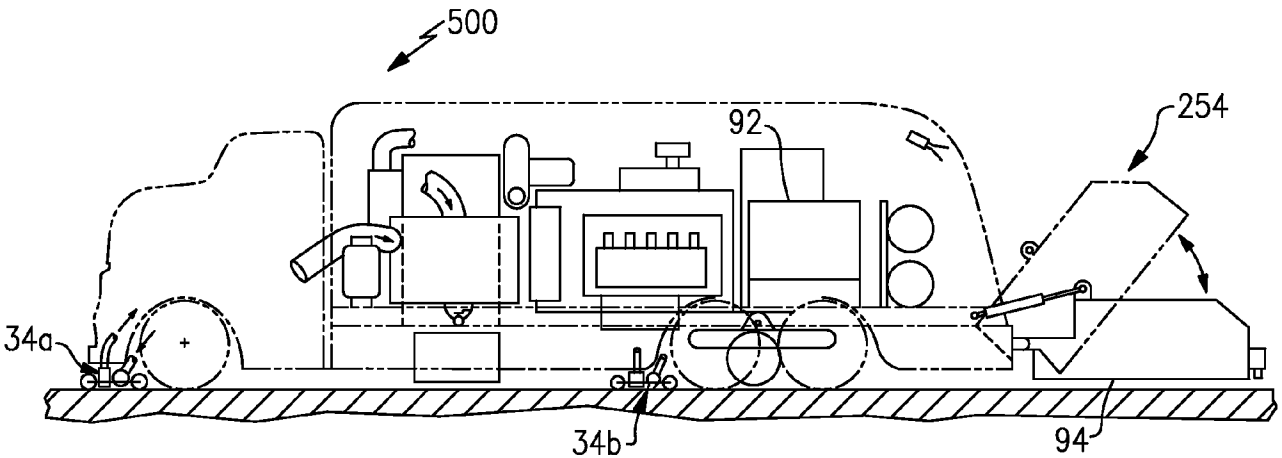
FIG. 9 illustrates another example mobile surface drying apparatus.

Yet another mobile surface drying apparatus 500 is depicted in FIG. 9. In this example, the mobile surface drying apparatus 500 includes a first vacuum and blower assembly 34A, a second vacuum and blower assembly 34B and an example dryer assembly 254. The example dryer assembly 254 includes a generator 92 and an infrared heating platform 94. The generator 92 powers the infrared heating platform 94 and forces heated air onto the surface 12 to further facilitate the removal of moisture from the surface 12. In this example, the infrared heating platform 94 is a direct flame heated platform.

Figure 10:
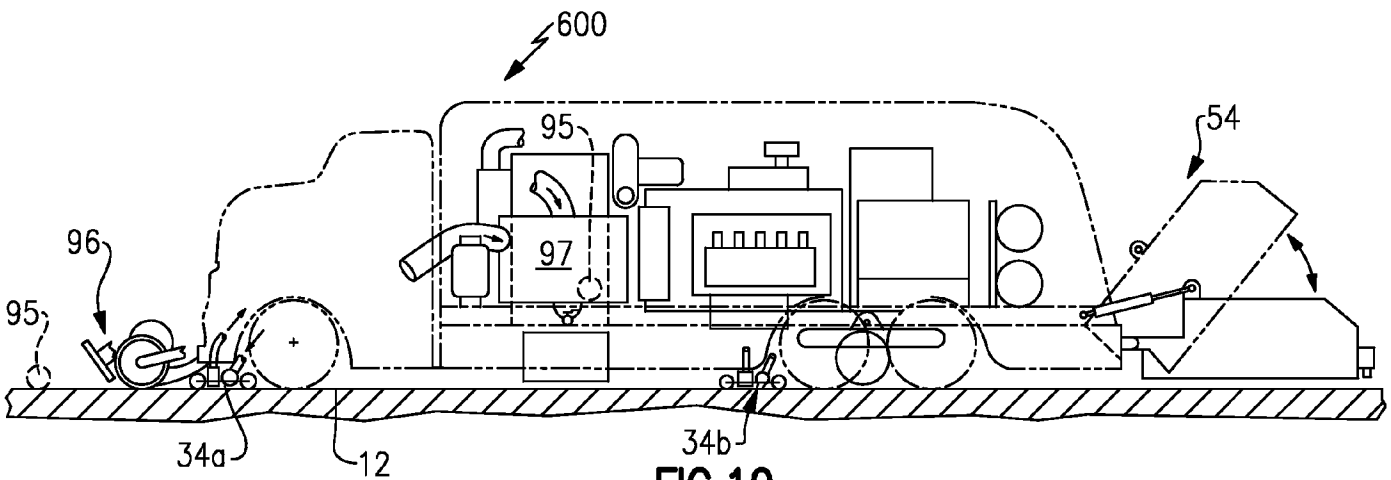
FIG. 10 illustrates yet another example mobile surface drying apparatus.

FIG. 10 illustrates another example mobile surface drying apparatus 600. In this example, the mobile surface drying apparatus 600 includes a vacuum and blower assembly 34, a dryer assembly 54 and a debris management system 96. The debris management system may include multitask surface cleaning functions such as power brooming, liter pickup, metallic pick up and other debris management. That is, the mobile surface drying apparatus 600 is capable of removing moisture 14 as well as debris 95 from the surface 12. In this example, the mobile surface drying apparatus 600 includes a holding chamber 97 for temporarily storing the debris 95 that is collected by the debris management system 96.

A person of ordinary skill in the art having the benefit of this disclosure would be able to implement a debris management system 96 within any of the example mobile surface drying apparatuses 10, 100, 200, 300, 400, 500 and 600. In this example, the debris management system 96 is mounted to a front most portion of the operator cab 16. However, other mounting locations are contemplated as within the scope of this disclosure.

Although specific features of this disclosure are illustrated in some figures and not in others, this is for convenience only; as each feature may be combined with any or all of the other features in accordance with this disclosure.

The foregoing description shall be interpreted as illustrative and not in any limiting sense. A worker of ordinary skill in the art having the benefit of this disclosure would recognize that certain modifications could come within the scope of the disclosure. For these reasons, the following claims should be studied to determine the true scope and content of this disclosure.

What is claimed is:

1. A mobile surface drying apparatus, comprising:

a vehicle structure positioned to traverse along a surface;

a carriage integrated with said vehicle structure;

a first vacuum and blower assembly mounted to one of said vehicle structure and said carriage, wherein said first vacuum and blower assembly includes a vacuum head powered by a vacuum fan and a blower head positioned next to said vacuum head and powered by a blower fan, wherein tubing connects said vacuum head to said vacuum fan and said blower head to said blower fan, and said vacuum head includes an inlet that suctions moisture from said surface and said blower head includes an outlet that communicates airflow onto said surface to direct moisture toward said vacuum head to enable said vacuum head to extract the moisture from said surface; and a second vacuum and blower assembly mounted at an aft position from said first vacuum and blower assembly.

2. The apparatus as recited in claim 1, comprising a drier assembly mounted to said carriage at an aft position from said first vacuum and blower assembly.

3. The apparatus as recited in claim 2, wherein said drier assembly includes a blower assembly, a burner and a forced air platform.

4. The apparatus as recited in claim 2, wherein said drier assembly includes a generator and an infrared heating platform.

5. The apparatus as recited in claim 2, wherein said drier assembly includes an airflow system, a jet burner system and a forced air platform.

6. The apparatus as recited in claim 1, comprising a debris management system mounted to said vehicle structure.

7. The apparatus as recited in claim 6, wherein said debris management system is mounted to a front portion of said vehicle structure.

8. The apparatus as recited in claim 1, comprising a traction control system that is selectively engageable relative to said surface.

9. The apparatus as recited in claim 1, comprising an internal combustion engine and a hydraulic system.

10. The apparatus as recited in claim 1, wherein said surface is a roadway.

11. The apparatus as recited in claim 1, wherein wheels of said mobile surface drying apparatus are powered by a hydrostatic drive and said first vacuum and blower assembly and said second vacuum and blower assembly are powered by an internal combustion engine.

12. The apparatus as recited in claim 1, comprising a communication interface that selectively commands engagement of said first vacuum and blower assembly and said second vacuum and blower assembly relative to said surface to remove said moisture from said surface.

13. The apparatus as recited in claim 1, comprising a plurality of video cameras that provide visual confirmation of a positioning of at least one of said first vacuum and blower assembly and said second vacuum and blower assembly.

* * * * *